US007744480B2

(12) United States Patent
Gobush

(10) Patent No.: US 7,744,480 B2
(45) Date of Patent: Jun. 29, 2010

(54) ONE CAMERA CLUB MONITOR

(75) Inventor: William Gobush, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 1621 days.

(21) Appl. No.: 10/759,080

(22) Filed: Jan. 20, 2004

(65) Prior Publication Data

US 2005/0159231 A1 Jul. 21, 2005

(51) Int. Cl.
*A63B 69/36* (2006.01)
*A63B 57/00* (2006.01)

(52) U.S. Cl. ..... 473/219; 473/150; 473/151; 473/152; 473/155; 473/156; 473/198; 473/199; 473/200; 473/220; 473/221; 473/222; 473/223; 473/280; 473/378

(58) Field of Classification Search ..... 473/198–200, 473/150–152, 155, 156, 219–223, 378, 280
See application file for complete search history.

(56) References Cited

U.S. PATENT DOCUMENTS

| | | | | |
|---|---|---|---|---|
| 2,783,999 | A | 3/1957 | Simjian | 273/185 |
| 2,933,681 | A | 4/1960 | Crain | 273/186 |
| 3,160,011 | A | 12/1964 | Ogden | 273/186 |
| 3,513,707 | A | 5/1970 | Russell et al. | 273/183 |
| 3,563,553 | A * | 2/1971 | Baldwin et al. | 473/164 |
| 3,918,073 | A | 11/1975 | Henderson et al. | 354/120 |
| 3,992,012 | A | 11/1976 | Campbell | 273/186 |
| 4,063,259 | A | 12/1977 | Lynch et al. | 354/120 |
| 4,136,387 | A | 1/1979 | Sullivan et al. | 364/410 |
| 4,137,566 | A | 1/1979 | Haas et al. | 364/410 |
| 4,158,853 | A | 6/1979 | Sullivan et al. | 358/93 |
| 4,160,942 | A | 7/1979 | Lynch et al. | 350/120 |
| 4,223,891 | A | 9/1980 | Gaasbeek | 273/186 |
| 4,306,723 | A | 12/1981 | Rusnak | 273/186 |
| 4,375,887 | A | 3/1983 | Lynch et al. | 273/32 |
| 4,461,477 | A | 7/1984 | Stewart | 273/26 R |
| 4,477,079 | A | 10/1984 | White | 273/186 R |
| 4,695,888 | A | 9/1987 | Peterson | 358/213.13 |
| 4,695,891 | A | 9/1987 | Peterson | 358/213.3 |
| 4,713,686 | A | 12/1987 | Ozaki et al. | 385/107 |
| 4,858,934 | A | 8/1989 | Ladick et al. | 273/186 A |
| 4,991,850 | A | 2/1991 | Wilhelm | 273/186 |
| 5,054,785 | A | 10/1991 | Gobush et al. | 273/184 R |
| 5,101,268 | A | 3/1992 | Ohba | 358/88 |
| 5,111,410 | A | 5/1992 | Nakayama et al. | 364/551.01 |
| 5,179,441 | A | 1/1993 | Anderson et al. | 358/88 |
| 5,210,603 | A | 5/1993 | Sabin | 358/93 |

(Continued)

OTHER PUBLICATIONS

U.S. Appl. No. 10/656,882, filed on Sep. 8, 2003 entitled "Multishutter Club-Ball Analyzer".

(Continued)

*Primary Examiner*—Peter DungBa Vo
*Assistant Examiner*—Jason Pinheiro
(74) *Attorney, Agent, or Firm*—Hanify & King, P.C.

(57) ABSTRACT

This application relates to a single camera monitoring system useful for determining parameters relating to a striking instrument as it approaches an object. The monitoring system may be used to determine the swing characteristics of a golf club as it approaches and impacts with a golf ball. The accuracy of the single camera system may be comparable to the accuracy of more complex, multi-camera systems. The application also relates to methods for calibrating a single camera system.

35 Claims, 8 Drawing Sheets

U.S. PATENT DOCUMENTS

| | | | | |
|---|---|---|---|---|
| 5,297,796 | A | 3/1994 | Peterson | 273/183.1 |
| 5,342,054 | A | 8/1994 | Chang et al. | 273/186.1 |
| 5,401,026 | A | 3/1995 | Eccher et al. | 273/184 R |
| 5,413,345 | A * | 5/1995 | Nauck | 473/156 |
| 5,471,383 | A | 11/1995 | Gobush et al. | 364/410 |
| 5,486,001 | A * | 1/1996 | Baker | 473/266 |
| 5,501,463 | A | 3/1996 | Gobush et al. | 273/184 R |
| 5,575,719 | A * | 11/1996 | Gobush et al. | 473/223 |
| 5,589,628 | A | 12/1996 | Braly | 73/12.02 |
| 5,626,526 | A | 5/1997 | Pao et al. | 473/156 |
| 5,803,823 | A | 9/1998 | Gobush et al. | 473/223 |
| 5,846,139 | A * | 12/1998 | Bair et al. | 473/156 |
| 6,011,359 | A | 1/2000 | Days | 315/241 |
| 6,034,723 | A | 3/2000 | Fujimori | 348/208 |
| 6,042,483 | A | 3/2000 | Katayama | 473/199 |
| 6,241,622 | B1 | 6/2001 | Gobush et al. | 473/199 |
| 6,375,579 | B1 * | 4/2002 | Hart | 473/131 |
| 6,533,674 | B1 | 3/2003 | Gobush | 473/199 |
| 6,561,917 | B2 | 5/2003 | Manwaring | 473/151 |
| 6,579,190 | B2 * | 6/2003 | Yamamoto | 473/141 |
| 6,758,759 | B2 | 7/2004 | Gobush et al. | 473/131 |
| 7,062,082 | B2 * | 6/2006 | Miki et al. | 382/154 |
| 7,209,576 | B2 * | 4/2007 | Rankin | 382/107 |
| 7,214,138 | B1 * | 5/2007 | Stivers et al. | 473/199 |
| 2002/0155896 | A1 * | 10/2002 | Gobush et al. | 473/197 |
| 2002/0173367 | A1 * | 11/2002 | Gobush et al. | 473/197 |
| 2003/0040373 | A1 * | 2/2003 | Chamberlain et al. | 473/132 |
| 2003/0054327 | A1 * | 3/2003 | Evensen | 434/252 |
| 2004/0032970 | A1 * | 2/2004 | Kiraly | 382/103 |
| 2004/0114033 | A1 * | 6/2004 | Eian et al. | 348/42 |
| 2005/0013467 | A1 * | 1/2005 | McNitt | 382/107 |

OTHER PUBLICATIONS

U.S. Appl. No. 10/667,479, filed Sep. 23, 2003 entitled "Golf Club and Ball Performance Monitor Having An Ultrasonic Trigger".

Pulnix Imaging Products Catalog, Pulnix Industrial Products Division, "TM-6705AN Progressive Scan Async Shutter & Readout Camera" (71-0022 Rev. A Printed Jun. 1999).

* cited by examiner

ONE CAMERA CLUB MONITOR

FIELD OF THE INVENTION

The present invention relates to a striking instrument and struck object monitoring system including one shutterable camera unit, which observes a field of view of which the camera receives light patterns from a plurality of contrasting areas on the instrument and the object in rapid successive sequence. A computer receives the signals generated by the light patterns as received by the camera and discriminates between the signals to determine the instrument's movement and orientation, as well as the conditions at impact with the object.

BACKGROUND OF THE INVENTION

In general, devices for measuring golf ball flight characteristics are well known. In addition, techniques of detecting golf clubhead position and golf ball position shortly after impact using photoelectric means to trigger a flash to permit a photograph to be taken of the clubhead have been disclosed. Golf ball or golf clubhead movement has been determined by placing reflective areas on a ball along with use of electro-optical sensors. The electro-optical sensing of light sources on both the golfer body and his club, as well as an apparatus for monitoring a golfer and the golf club being swung, has been disclosed. Typically, these known systems use two or more cameras to achieve desirable accuracy by triangulating the position of markers from two or more different camera angles or views.

To date, however, no satisfactory system for accurately sensing golf club head movement using a single camera has yet been proposed.

SUMMARY OF THE INVENTION

Broadly, the present invention comprises method and apparatus for measuring the speed, direction and orientation of a striking instrument such as golf club head before the point of impact of the instrument against the ball or other object to be struck and from such data computing conditions of instrument movement prior to impact.

The method and apparatus of the present invention particularly may be applied to golf equipment. In this embodiment, the present invention provides a golfer with data relating to the variables of his swing useful for improving his swing and for selecting equipment such as golf balls and golf clubs that may be better suited or tailored for the golfer's swing characteristics.

Another feature of the present invention is that it may be used for analyzing movement of other sports striking instruments.

One embodiment of the present invention is directed to a single-camera system for monitoring the movement of a striking instrument, such as a golf club, that impacts with an object, such as a golf ball. In this embodiment, the system has a single camera unit having a light sensitive panel that is capable of being focused on a field of view through which the striking instrument passes prior to striking the object. The camera unit may be capable of shuttering or gating at least twice as the striking instrument and/or the object pass through the field of view. Contrasting areas may be provided on the striking instrument and object so that light projected toward the field of view can be reflected or emitted toward the camera to form images on the light sensitive panel. For example, the striking instrument may have three or more, and more preferably four or more contrasting areas.

The system of this embodiment also has an image analyzer capable of discriminating between the striking instrument contrasting areas and the object contrasting areas and determining the conditions of the path and orientation of the instrument through the field. Furthermore, the striking instrument of this embodiment may be calibrated such that the single-camera system is capable of identifying the position and orientation of its face from the striking instrument contrasting areas.

Several additional features may be provided to the embodiment described above. For instance, the striking instrument may be calibrated in several ways. In one embodiment, the striking instrument is calibrated such that the spatial locations of the contrasting areas are known relative to the geometric center of the striking face. In another embodiment, the striking instrument is calibrated such that the body coordinates of the striking instrument are known relative to the striking instrument contrasting areas. And in yet another embodiment, the striking instrument is calibrated with a priori knowledge of the spatial locations of the striking instrument contrasting areas.

In addition, the monitor system of the present invention may have a calibration fixture having a plurality of contrasting areas, wherein the three-dimensional positions of the calibration fixture contrasting areas are known relative to each other. In another embodiment, the monitor system of the present invention may have a calibration attachment that can be disposed on the face of the striking instrument. The calibration attachment may have a plurality of contrasting areas disposed on its surface. Preferably, the three-dimensional positions of the calibration attachment contrasting areas are known relative to each other.

In one embodiment, the single camera unit may be configured to capture at least one image of the striking instrument approximately when it is impacting with the object. In another embodiment, the system may have an electronic light source that emits light in two flashes onto the instrument and object. In yet another embodiment, the striking instrument has four contrasting areas and the object has six contrasting areas.

While the present invention may be used to monitor the speed, direction, and orientation of a variety of striking instruments and objects, in one embodiment the striking instrument is a golf club comprising a club head, such as a putter, an iron, or a driver, and the object is a golf ball. In addition, the image analyzer may be capable of determining the club head path and face orientation during a swing of the club. Moreover, in one embodiment the image analyzer is capable of determining the location of impact of the golf ball on the club face.

As described in greater detail below, the present invention is capable of accurately measuring the striking instrument and object. For instance, in one embodiment the accuracy of the system or of the image analyzer for determining the golf ball impact location is within 0.25 inch. In another embodiment, the accuracy of the system or of the image analyzer for determining the golf ball impact location is within 0.10 inch. In yet another embodiment, the accuracy of the system or of the image analyzer for determining the golf ball impact location is comparable to the accuracy of a 2-camera system.

In yet another embodiment, the system or the image analyzer is capable of determining one or more of a droop angle, a loft angle, a face angle, a path angle, or an attack angle of the golf club. Some embodiments of the present invention relate to the accuracy of the system or image analyzer for determining these angles. For instance, in one embodiment the accuracy of the system or of the image analyzer for determining the golf club droop angle, loft angle, face angle, path angle, or attack angle is within 3 degrees. In another embodiment, the accuracy is within 1 degree, and in another embodiment it is comparable to the accuracy of a 2-camera system.

In some embodiments, the system or image analyzer is capable of determining the club head velocity with an accuracy within 20 feet per second. In another embodiment, the accuracy of the system or of the image analyzer for determining club head velocity is comparable to the accuracy of a 2-camera system. In one embodiment, camera unit is capable of shuttering or gating at least three times as the striking instrument and object pass through the field of view.

A triggering unit may be used with the present invention. One advantage of providing a triggering unit is that it may be useful for determining when the single camera captures an image of the striking instrument and object. In one embodiment, the triggering unit comprises a light source, a reflector, and an optical sensor. In another embodiment, the triggering system comprises an ultrasonic emitter and receiver.

Some embodiments of the present invention concern methods for calibrating a striking instrument with a one-camera monitoring system. For example, one method of the present invention involves the steps of providing a single camera unit having a light sensitive panel that is capable of being focused on a first field of view, placing a striking instrument having a first plurality of contrasting areas within the first field of view of the single camera unit to provide a first perspective view of the striking instrument and first plurality of contrasting areas, capturing a first image of the first perspective view of the striking instrument and first plurality of contrasting areas, providing a second perspective view of the striking instrument and first plurality of contrasting areas, capturing a second image of the second perspective view of the striking instrument and first plurality of contrasting areas, and analyzing the first plurality of contrasting areas in the first and second images of the striking instrument to determine their three-dimensional positions.

In one embodiment, the first perspective view of the striking instrument and first plurality of contrasting areas differs from the second perspective view of the striking instrument and first plurality of contrasting areas from about 5 to about 10 degrees. In another embodiment, the step of providing a second perspective view of the striking instrument and first plurality of contrasting areas comprises repositioning the striking instrument. In yet another embodiment, the step of providing a second perspective view of the striking instrument and first plurality of contrasting areas further comprises maintaining the first field of view of the camera.

A calibration fixture may also be used in the methods or included as a component of the systems of the present invention. For instance, one embodiment of the present invention involves providing a calibration fixture having a plurality of contrasting areas for which their three-dimensional positions on the calibration fixture are known relative to each other. The calibration fixture may be placed in a field of view of the single camera unit to provide two or more perspective views of the calibration fixture and contrasting areas. Images of the perspective views of the calibration fixture may be captured and used to establish a three-dimensional global coordinate system for the system. Preferably, one axis of the global coordinate system is parallel to gravity, a second axis of the global coordinate system is directed toward a target, and a third axis of the global coordinate system is orthogonal to the first and second axes.

In some embodiments, the steps of obtaining images of one, two or more perspective views of various components of the present invention may be combined. For instance, the steps of capturing perspective views of the striking instrument and of the calibration fixture may be performed at the same time.

As mentioned above, a calibration attachment may also be used in the present invention. In one embodiment, the calibration attachment may have a plurality of contrasting areas with their three-dimensional positions being known relative to each other. In use, the calibration fixture may be placed on the striking instrument, such as on the face of a golf club. The positioning of the calibration attachment may be selected so that the first and second captured images of the first and second perspective views of the striking instrument and first plurality of contrasting areas further also comprise images of the contrasting areas of the calibration attachment when disposed on the striking instrument. Once the images are captured, the calibration attachment may then be removed.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1A:
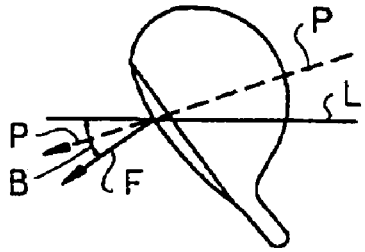
FIG. 1(*a*)-(*i*) illustrate various golf clubhead face orientations and clubhead paths at impact.
Figure 1B:
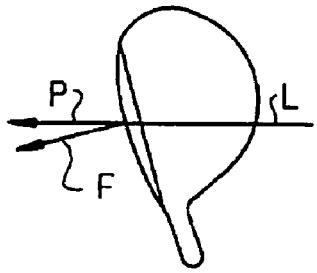
Figure 1C:
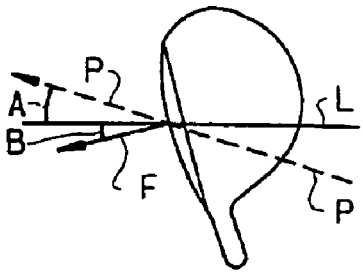
Figure 1D:
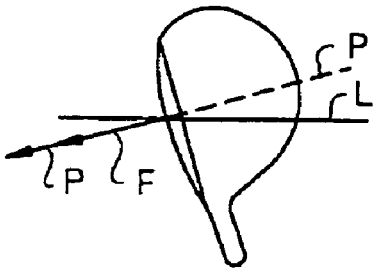
Figure 1E:
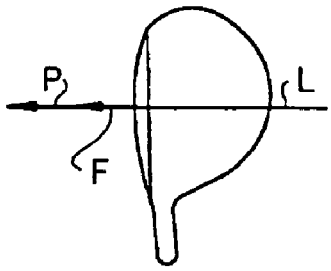
Figure 1F:
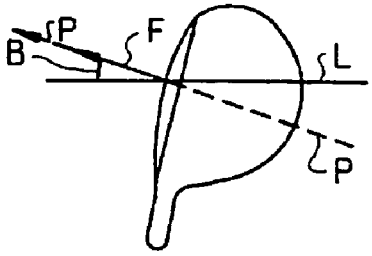
Figure 1G:
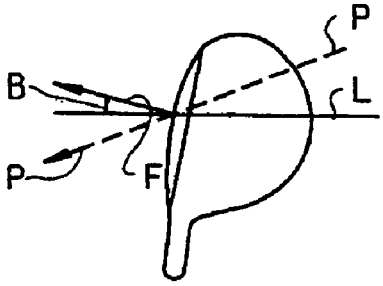
Figure 1H:
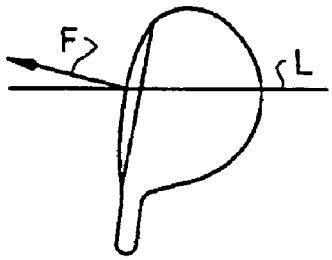
Figure 1I:
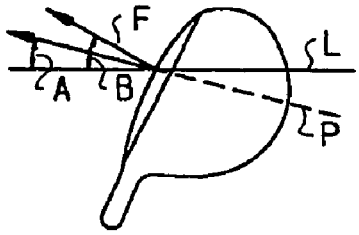

The present invention is directed to determining the kinematic motion of a golf club (i.e., golf club driver, golf club iron, golf club putter) by photogrammetric analysis by one camera view of club motion prior to impacting a golf ball. Such a system solves the problem of requiring two cameras to monitor a club motion event in golf by use of an inexpensive camera system that can be used commercially to train and assist the general golfing public how to improve their equipment and play.

Generally, a camera is triggered to expose by a photosensor just prior to impact with a golf ball, where at least two images are taken and frozen on the same frame with a strobe light or other light source and the golf club is marked with markers, such as fluorescent or retroreflective markers. Preferably, markers are disposed on four or more locations on the club, such as on the clubhead and/or on the club shaft. Three coordinate frames allow meaningful data to be extracted from one captured image of two positions of the clubhead.

There are five (5) conditions of golf clubhead movement which determine the flight of the ball as impacted by the clubhead. In particular, such conditions include "Clubhead speed" which affects ball speed and in turn distance (approximately 2½ yards of distance is gained for every mph of club speed); "Clubhead path" measured in a horizontal plane which affects the direction the ball will travel; "Clubhead attack angle" measured in a vertical plane which affects the launch angle and the backspin of a golf ball; "Face orientation" which includes squareness measured with respect to a horizontal line perpendicular to intended line of flight which affects the hook/slice spin on the golf ball and loft variation which affects the backspin and launch angle; and "Location of ball contact" on the face which includes up and down the face and from heel to toe. Location of ball contact effects ball flight in that it affects launch angle and spin rate.

FIGS. 1(*a*)-(*i*) illustrate various clubhead paths in horizontal planes and face orientations at impact. The clubhead path P is angle A measured in degrees from the intended initial line of flight of the ball $L_i$. The face orientation angle is angle B measured between the line of flight $L_i$ and clubhead face direction indicated by arrow F.

Turning in particular to FIG. 1(*a*), club path P is from outside-to-inside at impact producing a negative A angle and the face is closed producing a negative angle B. The result is a pull hook shot.

FIG. 1(*b*) shows the clubhead path P along line $L_i$ and the clubhead closed with a negative angle B which conditions produce a hook;

FIG. 1(*c*) shows the clubhead path P such that angle A is positive while a closed face creates a negative angle B for a push hook shot;

FIG. 1(*d*) shows the P and F coinciding at an angle to $L_i$ producing a pull shot;

FIG. 1(*e*) shows a straight flight shot;

FIG. 1(*f*) shows conditions that produce a push;

FIG. 1(*g*) whose conditions that result in a pull slice shot;

FIG. 1(*h*) shows the clubhead path P along the line $L_i$, but with the club face open to produce a slice; and FIG. 1(*i*) shows the condition for a push slice.

Figure 2A:
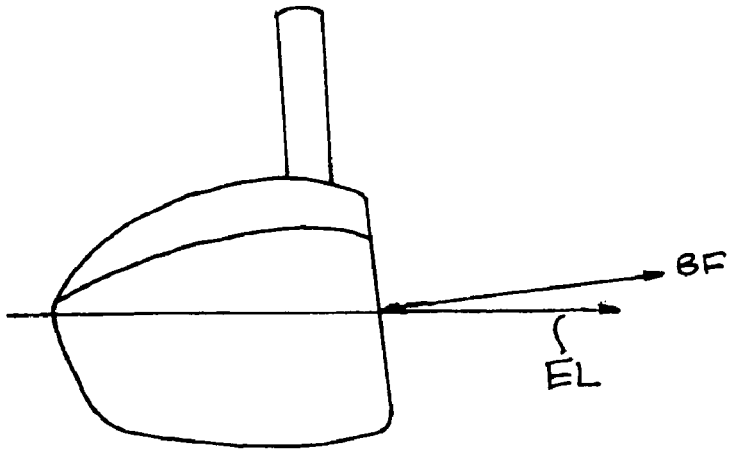
FIG. 2(*a*)-(*c*) illustrate golf clubhead paths and effect on ball flight.
Figure 2B:
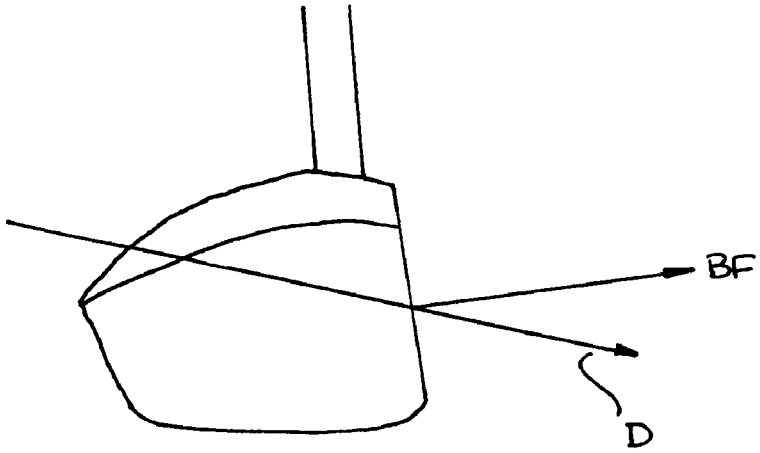
Figure 2C:
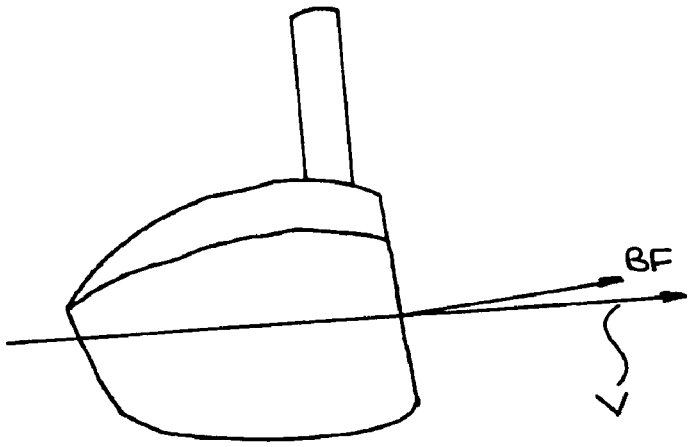

FIGS. 2*a-c* shows a clubhead having a level attack angle EL; descending attack angle D; and rising attack angle V producing ball flights of BF.

Figure 3A:
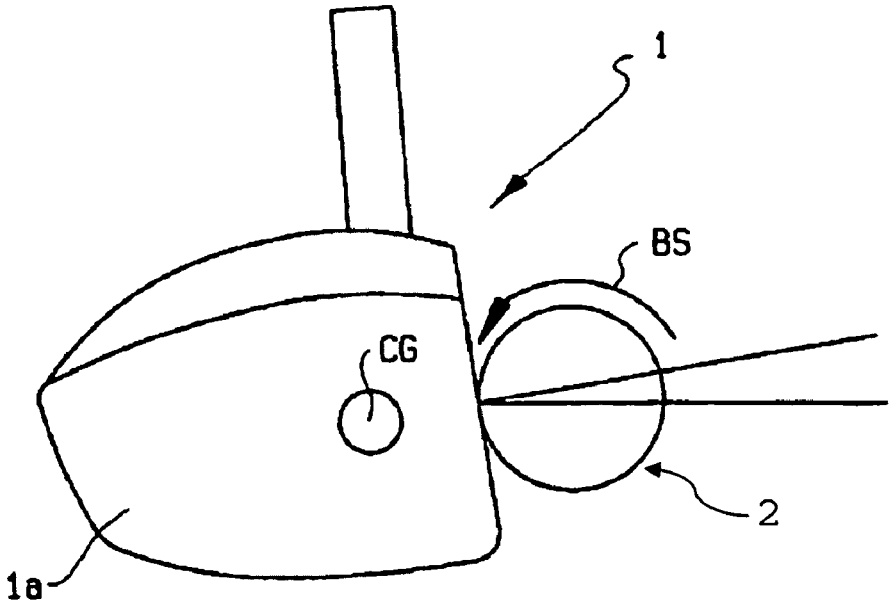
FIG. 3(*a*)-(*b*) illustrate golf wood club head-to-ball engagement positions and resulting spin.
Figure 3B:
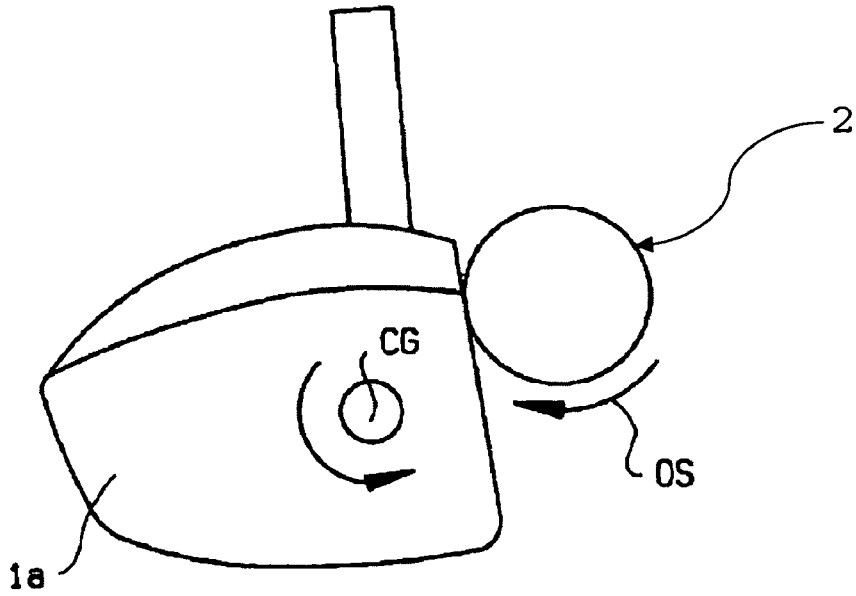
Figure 4:
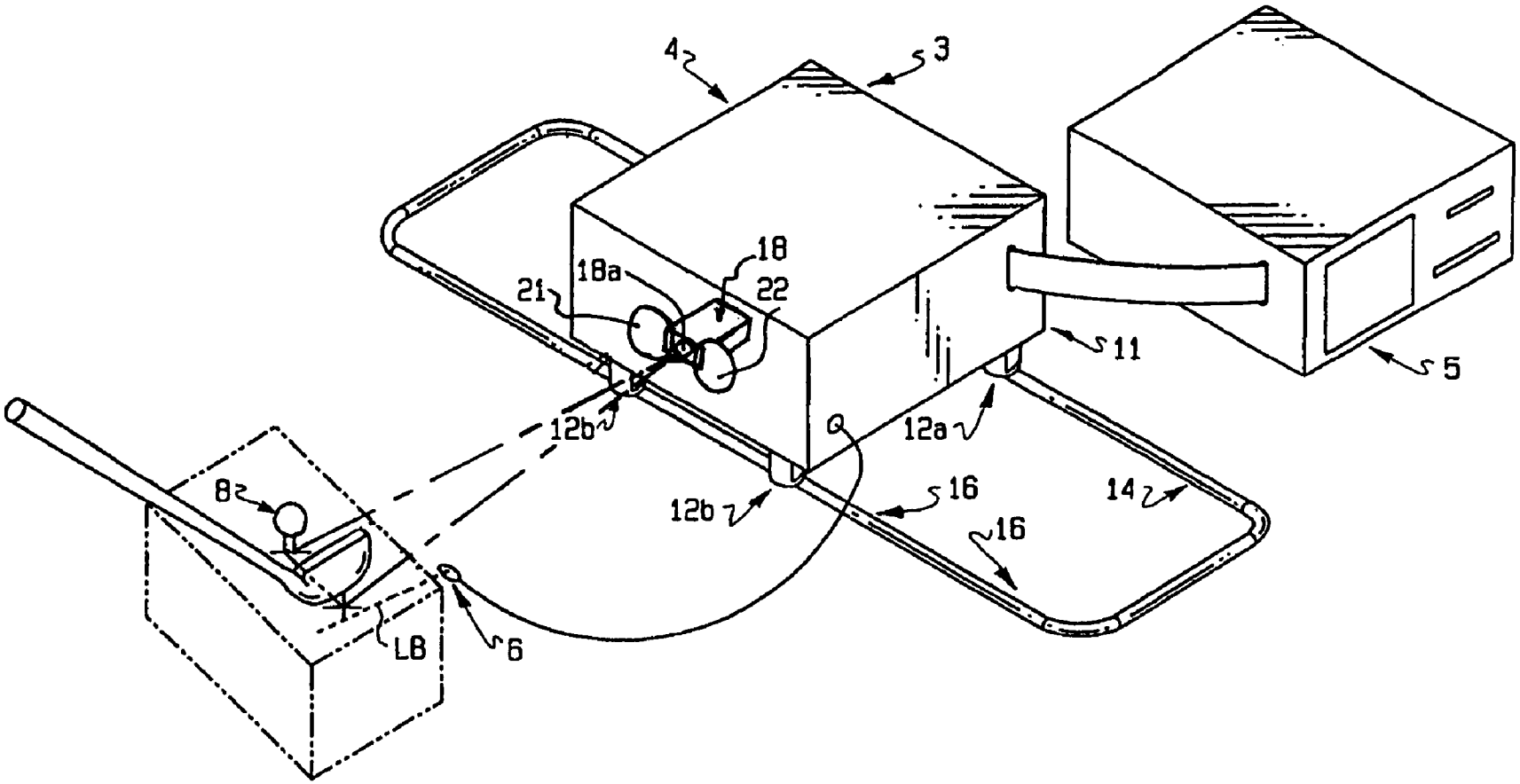
FIG. 4 is a perspective view of the apparatus of the present invention including one camera positioned adjacent a golf club head at addressing and a teed golf ball.

In FIGS. 3*a*-3*b*, wooden club 1 produces backspin BS when striking ball 2 at the center of gravity CG of the clubhead 1*a*. Overspin OS is generated when the ball is struck above the CG and the clubface has zero loft angle.

Now referring to the FIGS. 4-8, system 3 includes camera housing unit 4, computer 5, sensor 6 and teed golf ball 8. Camera unit 4 includes housing frame 11 and support feet 12*a*, 12*b* engageable with tracks 14, 16 so that the unit 4 can be adjusted relative to teed ball 8. Camera unit 4 further includes one electro-optical camera 18, which has a light-receiving aperture 18*a*, shutters (not shown) and a light sensitive silicon panel 18*p* (see FIG. 8). In one embodiment, the camera unit is a CCD camera or a TV-type camera. Preferably, the camera unit is a CCD camera, although other types of sensors may also be used.

Figure 5:
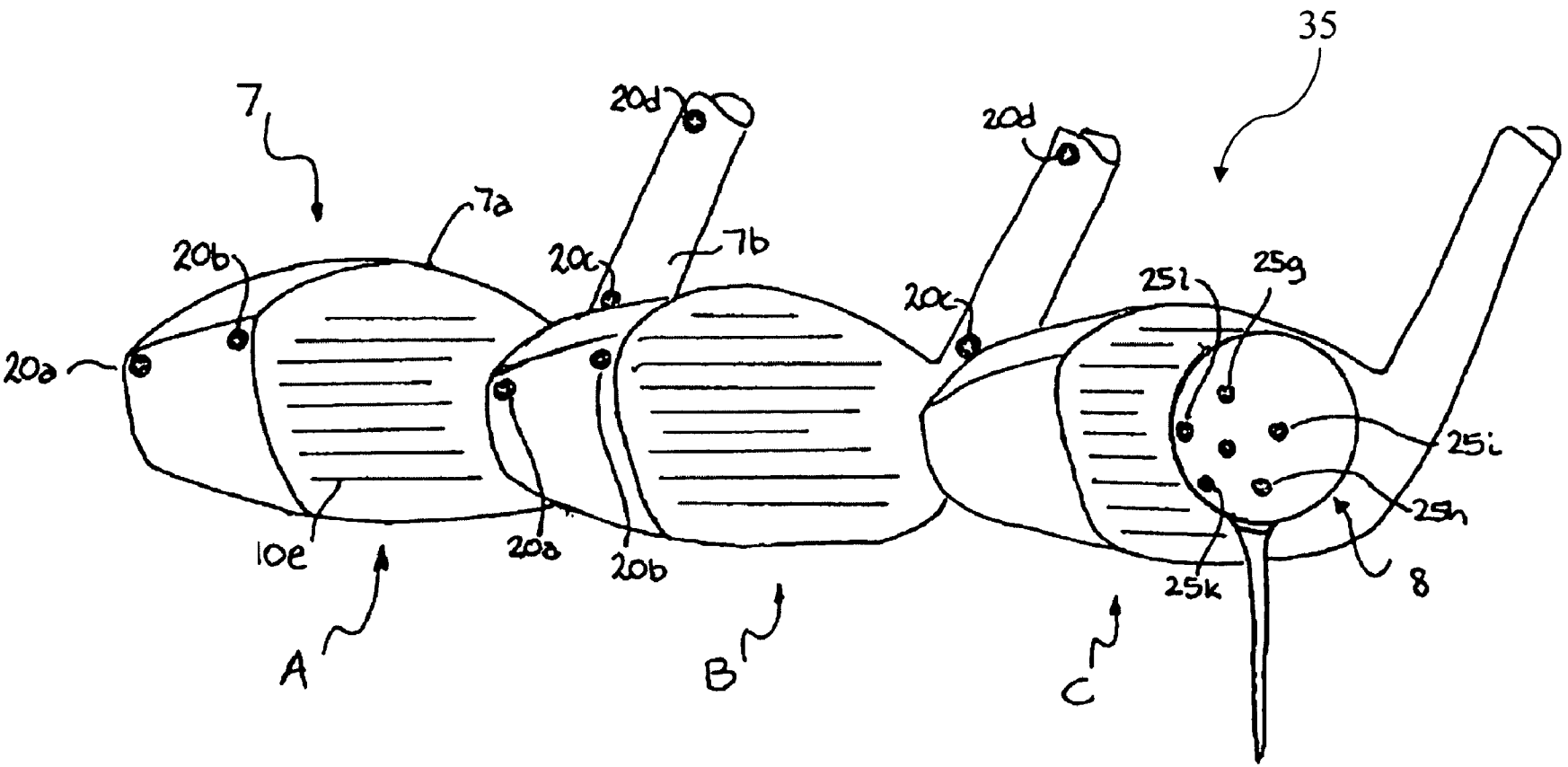
FIG. 5 is a perspective view of a three-dimensional rectilinear field showing a golf club head unit passing from measured position A to measured position B to projected impact position C.

Turning to FIG. 5, golf clubhead 7*a* and attached hosel 7*b* which together comprise clubhead unit 7 have four (4) retroreflective spaced-apart markers (e.g., round areas or dots) 20*a*, 20*b*, 20*c*, and 20*d* placed thereon, such markers typically being separated by at least about one inch from each other. Marker 20*a* is located at the rear of the clubhead, marker 20*b* is located top toe edge of the clubhead, marker 20*c* is located at the top heel edge of the clubhead, and marker 20*d* is located on the shaft about 1 inch above marker 20*c*. Markers 20*a-d* having diameters of 0.15 to 0.25 inch are preferred, but other size and shaped areas can be used. Markers 20*a-d* preferably are made of reflective material, which is adhered to the clubhead 7*a* and hosel 7*b* surface. Teed ball 8 has similar markers 25*g-l*. The "Scotchlite" brand beaded material made by Minnesota Mining and Manufacturing (3M) in St. Paul, Minn. is preferred for forming the dots. Alternatively, corner-reflective retroflectors or fluorescent markers that define contrasting areas can be used. In one embodiment, the number of markers on the club may be as few as four (4) and up to six (6) or more markers. The marker locations are selected so that each marker is capable of reflecting or emitting light toward the camera when the club is in positions A and B. As shown, the ball may likewise have a plurality of markers that indicate the location and orientation of the ball relative to the club. Additional types, shapes, and combinations of markers that may be used in the present invention are described in U.S. application Ser. No. 10/002,174, filed on Dec. 5, 2001 and also in U.S. application Ser. No. 10/656,882, filed on Sep. 8, 2003, the entireties of which is incorporated herein by reference.

For example, one embodiment of the invention comprises the use of at least four (4) retroreflective spaced markers or fluorescent markers that are typically spaced 1 inch apart from each other on a golf club, such as an iron. In particular, one marker can be placed at the top toe edge of the clubhead, a second marker at the lower toe edge of the clubhead, and two markers may be disposed on the shaft.

Camera 18 is capable of receiving light from each marker or dot 20*a-d* and 25*g-l*. When compared to a white coated surface of a golf ball, the light reflected from a marker may be as high as nine hundred (900) percent brighter than the light reflected from the white diffuse of the ball when the divergence angle between the beam of light striking the dots 20*a-d* and dots 25*g-l* the beam of light from such dots to the camera aperture is zero or close to zero. Preferably, the divergence angle between a beam of light striking the markers and the beam of light from the markers to the camera is from about 4° to about 0°, and more preferably is from about 1° to about 0°. As the divergence angle increases, the ratio of brightness of such dots 20*a-d* and dot 25*g-l* to the background decreases. It will be appreciated that infra red lighting may be used to make the flash light invisible to the golfer. It also will be appreciated that visible blue lighting may be used to excite fluorescent markers on club and ball. The camera for fluorescent markings may be fitted with a filter that only allows a limited spectrum of light at or near the wavelength of light at the emission frequency. For example, the filter may substantially filter out light having a wavelength that is more or less than 50 nm from the emission frequency.

Referring back to FIG. 4, two flash lamps 21, 22 are disposed near or adjacent to camera 18. Preferably, lamps 21 and 22 are placed as close to the viewing axis of the camera 18 as possible to minimize the divergence angle and this increases the ability of camera 18 to receive light from dots 20*a-d* and 25*g-l* and distinguish that light from light received from other portions of the clubhead unit 7, ball surface 8 and other background light. Alternatively, gating or shuttering can be accomplished by controlling the periods of time in which the light sensitive panels 18*p* will receive light and be activated by such light. A camera in which shuttering or gating is accomplished by operation of the sensor panels is a gated charge intensified camera. In this alternative, the light source is always on the camera shutters always open, thus employing light sensitive panel 18*p* to accomplish gating by gathering light only at a plurality of time periods separated by 800 microseconds. A second alternative utilizes a ferroelectric liquid crystal shutter, which opens and closes in 100 microseconds. In this alternative, a constant light source is used and shuttering occurs twice before the ball has been hit.

In addition to the above described image capturing processes, a multishutter camera also may be used in the present invention. Many features of a multishutter camera are described in U.S. Pat. No. 6,533,674, the entirety of which is incorporated herein by reference.

Club Calibration Methodology

In analyzing the motion of the clubhead with one camera, a body coordinate system may be created describing the position of the four markers on the club with an origin that can be related to the location of points on the clubface. The coordinate system can be created with a caliper by measuring the distance between the four markers to the center of the face. This manual procedure can be time consuming and often leads to inaccuracies due to errors in measurement. As a result, the following photogrammetric method allows for more accurate and automatic calibration of marker positions on a club.

Figure 9:
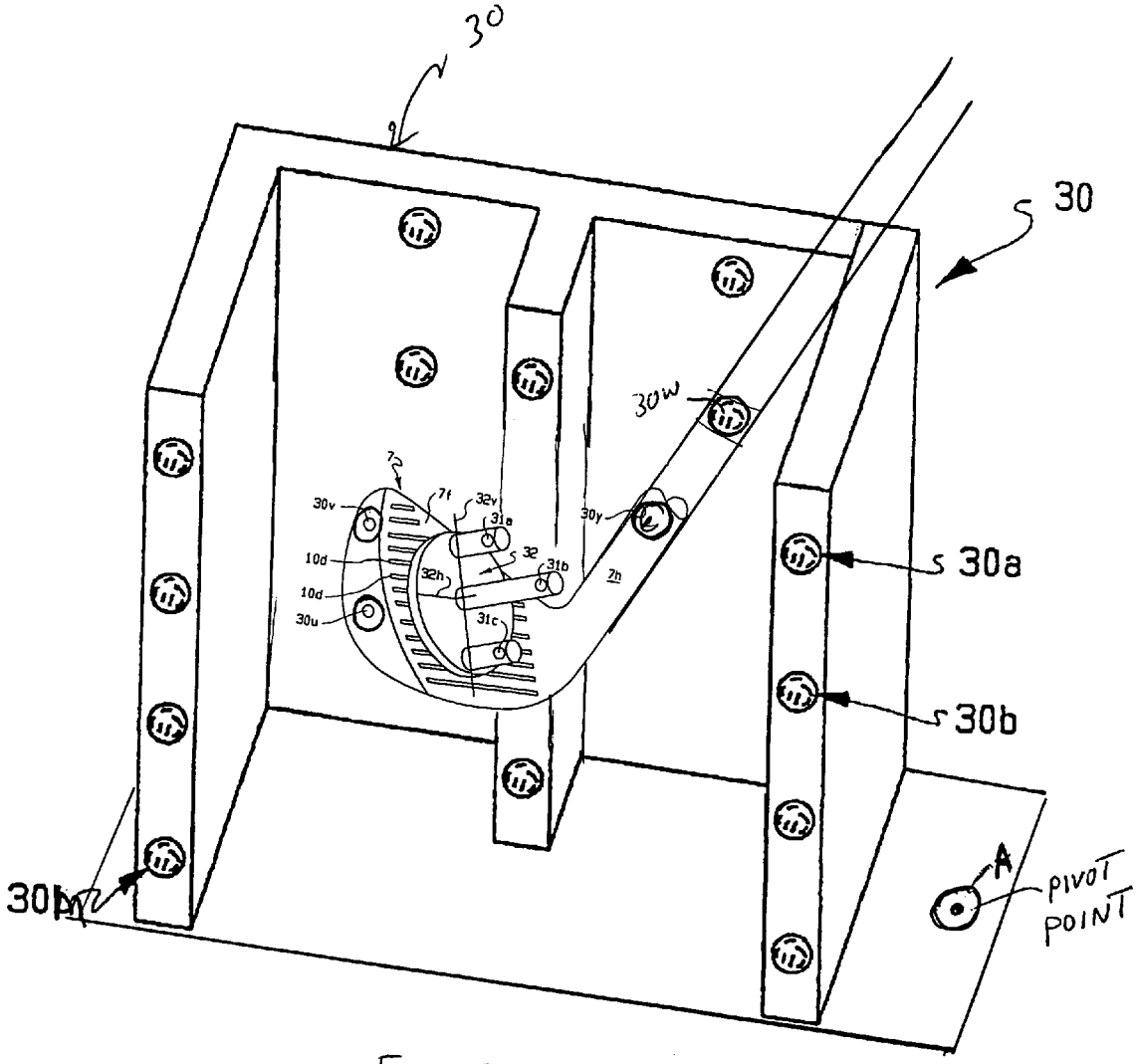
FIG. 9 is the club with attached calibration fixture contained in calibration test stand with pivoted joint for viewing at variable angles.

This more accurate and less time consuming method pivots the club and club fixture placed in a calibration fixture shown in FIG. 9 in order to calibrate the club. By pivoting the fixture about point A by about 5 to about 10 degrees, or by moving the camera to change the angle by a similar amount, the resulting two images on the camera sensor can be triangulated to determine the markers on the club in a body coordinate system. In this manner, a single camera system may be calibrated to significantly increase its accuracy so that it approximates or approaches the accuracy of a multiple camera systems without the added cost, system weight, and complexity often associated with multiple camera systems.

In this triangulation method, calibration of clubhead unit 7 is accomplished by disposing attachment 32 to club face 7*f*. In one embodiment, the attachment 32 may be associated with or disposed on the club face by magnetic forces, use of a putty or other adhesive, or by any other suitable manner. Vertical orientation line 32*v* and horizontal line 32*h* may be used to orient and locate attachment 32 on clubhead face 7*f* having club face grooves 10*d* etc. Other markers or indicators also may be used to help visually align or orient the attachment properly on the club face. For example, line 32*h* may be parallel to face grooves 10*d*. Attachment 32 may include three (3) retroreflective markers or dots 31*a-c*; clubhead unit 7 also may have retroreflective markers 30*u*, 30*v*, 30*w*, and 30*y*. It should be understood, however, that fluorescent markers also may also be used. Preferably, each marker is about ¼" in diameter.

Figure 7:
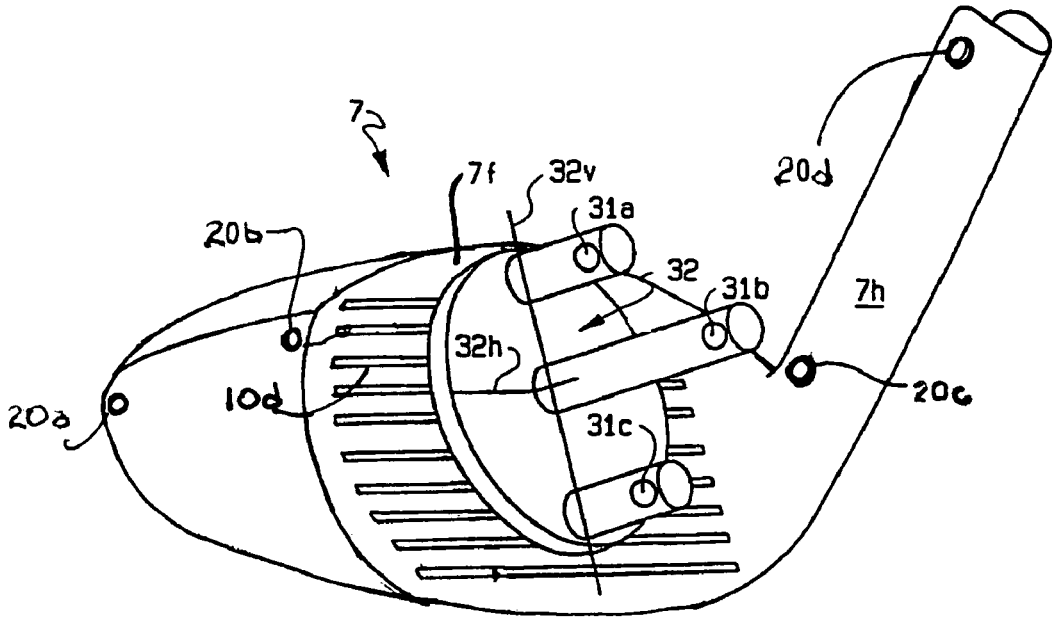
FIG. 7 is a perspective view of an attachment for providing initial golf clubhead information to the system.

Attachment 32 provides the system with information to locate the geometric center of face 7*f* which center is the proper location for ball impact. Attachment 32 forms a plane defining an axis system centered at the center of the clubface 7*f* (FIG. 7). By aligning the upper and lower dots on the club calibration attachment 32 perpendicular to the grooves of club head 7 unit, the vector between these two points defines the x-axis of a local face coordinate system. The vector normal to the plane of the three calibration points defines the y-axis direction and is parallel to the grooves. The normal to the x and the y axis vector defines the third rectangular direction called the z-axis which is a direction normal to the clubface 7*f* the system is operated by reflecting light off dot 31*a-c* to camera panel 18*p*.

From solving the unique rotational and translational relationship between the four markers or dots 30*u*, 30*v*, 30*w*, 30*y* on the club head unit 7 and the three (3) markers or dots 31*a*, 31*b*, 31*c*, the intended point of impact on the club (the sweet spot) can uniquely be found at any location of the swing in the field through reflective light from the dots 30*u,v,w,y* on the club unit 7. The attachment 32 may then removed from club face 7*a* after calibration is completed.

Club Calibration by Pivoting

In FIG. 9, the calibration points that surround the club calibration points are used to determine the eleven constants from sightings at two viewpoints that result from pivoting the calibration setup shown in FIG. 9.

The eleven constants determine the focal length, orientation and position of camera 18 given the premeasured points on fixture 30 and the thirteen U and V coordinates digitized on camera's sensor panel 18*p*.

Figure 8:
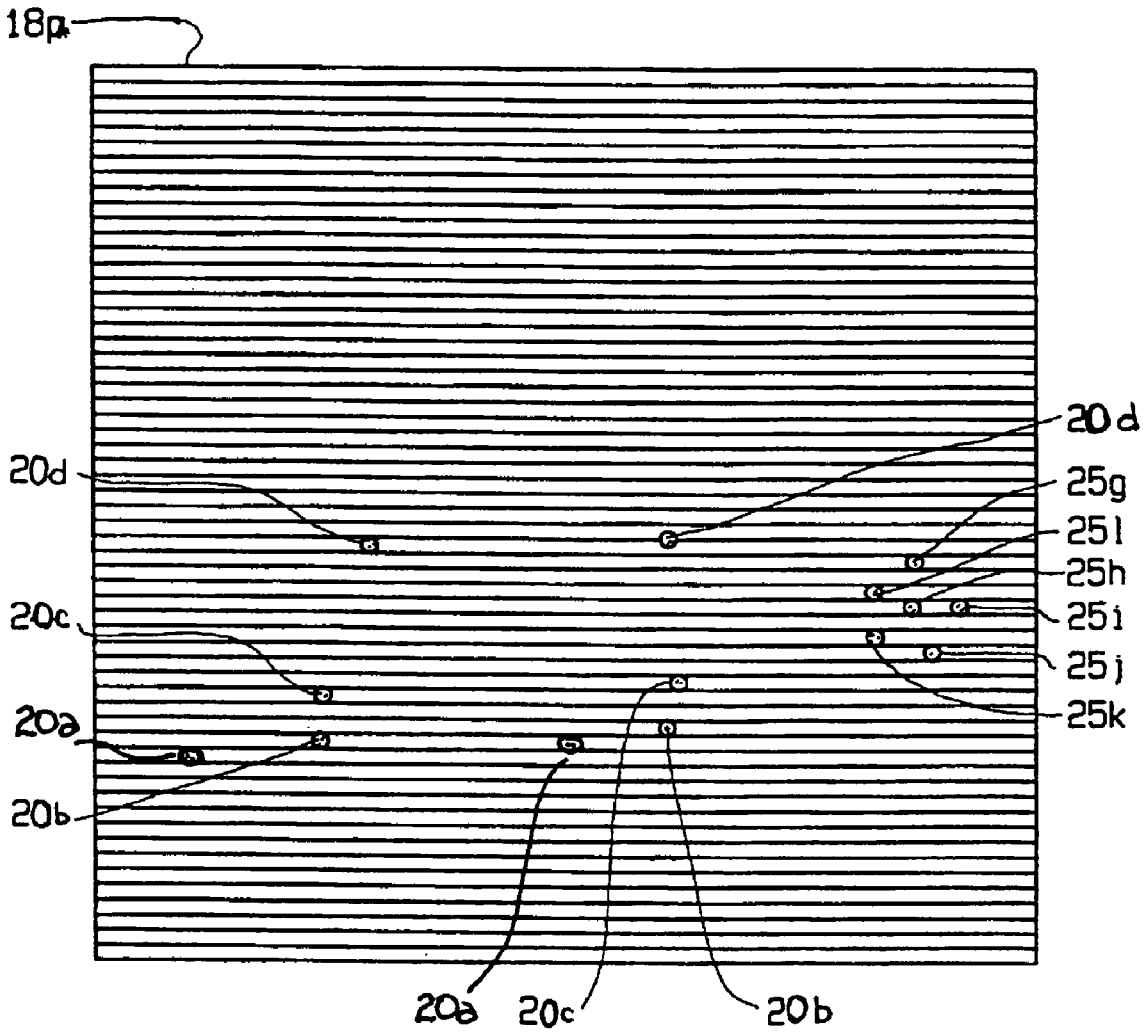
FIG. 8 is an elevational view of the light receiving and sensory grid panel located in each camera.

Sensor panel 18*p*, which receives successive light patterns, may have at least about 768 lines of data and at least about 1024 pixels per line, although other sized sensor panels may also be used with the present invention. The grid of FIG. 8 is illustrative even though it does not show all 768 lines. A computer algorithm may be used for centroid detection of each marker 25*g-l* on the golf ball and 20*a-d* on the golf club. Centroid detection of a marker is the location of the center area of the marker for greater accuracy and resolution. Each image received from markers 25*a-l*; 20*a-d* results in an apparent x and y center position of each dot. Where light is low in the field of vision due to gating, an image intensifier may be used in conjunction with the sensor panels. An image intensifier is a device which produces an output image brighter than the input image.

With respect to the calibration fixture, the X, Y and Z coordinates of the center of each dot 30*a-m* are arranged in a three-dimensional pattern with pre-measured accuracy of one of one-ten thousandth of an inch. Information regarding the X, Y, Z coordinates of the centers of markers 30*a-m* may then be electronically stored on a digitizing table in a computer in communication with the camera system of the present invention. Images of the calibration fixture 30 may then be taken by the camera 18 with the club from multiple angles or view points.

In one embodiment, described below, two images of the calibration fixture and club are obtained from two different angles or perspectives to calibrate the two-dimensional image of the camera with U,V coordinates to the three-dimensional X, Y, Z coordinates. While it is believed that obtaining two images from two different angles or perspectives is sufficient for obtaining a desired accuracy of a single camera system of the invention, additional images of the calibration fixture from other angles or perspectives may be obtained to further increase the accuracy of the system.

Because the coordinates of each marker on the calibration fixture are known, each image allows for the determination of the eleven (11) constants relating image space coordinates U and V to the known thirteen X, Y and Z positions on the calibration fixture 30. Equations 1 and 2 relate the calibrated X(i), Y(i), and Z(i) spaced points with the $U_j^{(i)}$, $V_j^{(i)}$ image points as follows:

$$U_j^i = \frac{D_{1j}X(i) + D_{2j}Y(i) + D_{3j}Z(i) + D_{4j}}{D_{9j}X(i) + D_{10j}Y(i) + D_{11j}Z(i) + 1} \quad \text{Equation 1}$$

$$V_j^i = \frac{D_{5j}X(i) + D_{6j}Y(i) + D_{7j}Z(i) + D_{8j}}{D_{9j}X(i) + D_{10j}Y(i) + D_{11j}Z(i) + 1} \quad \text{Equation 2}$$

Where:

i=1-13 (corresponding to each marker); and j=1-2 (corresponding to the number of camera angles or perspectives).

Using an example where two images are used to calibrate the camera (i.e., j=1-2), the eleven constants, $D_{i1}$ (i=1, 11) for camera 18 from a first image of the calibration fixture from a first angle or perspective are solved from knowing X(i), Y(i), Z(i) coordinates at the 13 precise marker locations and the corresponding 13 Uj(i), Vj(i) coordinates measured in the first calibration image from the camera 18.

Preferably, the camera angle or perspective relative to the calibration fixture for the second image may differ from the first by about 5° to about 10°. For instance, the camera may be rotated or moved from a first position where the first image was obtained to a second position where the second image is obtained. Likewise, the camera may remain in its first position while the calibration fixture is rotated or moved from a first position or orientation to a second position or orientation. For example, in one embodiment the calibration fixture may be pivoted or rotated by about 5 to about 10 degrees and a second image is obtained that allows the eleven constants $D_{i2}$ (i=1, 11) to be calculated in this second orientation.

Preferably, both of these scenes or images also capture or include the U,V image coordinates of each of the seven markers on the club with attachment. These image coordinates of the markers can then be mapped to three dimensional space measurements once the $D_{i1}$ and $D_{i2}$ (i=1, 11) coefficients are determined. To do this transformation we solve the four equations in three unknowns describing each point shown in Equations 1 and 2 with the unknowns now being club marker points X(i), Y(i), and Z(i); where i=1-7. These four equations are linear in X(i), Y(i), and Z(i) and therefore can be solved by the least squares method. With the club points now triangulated, the four points on the body of the club will uniquely be related to the three attachment markers. By tracking the four markers on the body of the club during the swing, the center of the face and its orientation is uniquely connected to these measured markers on the attachment.

Global Reference Coordinate System Construction

Figure 6:
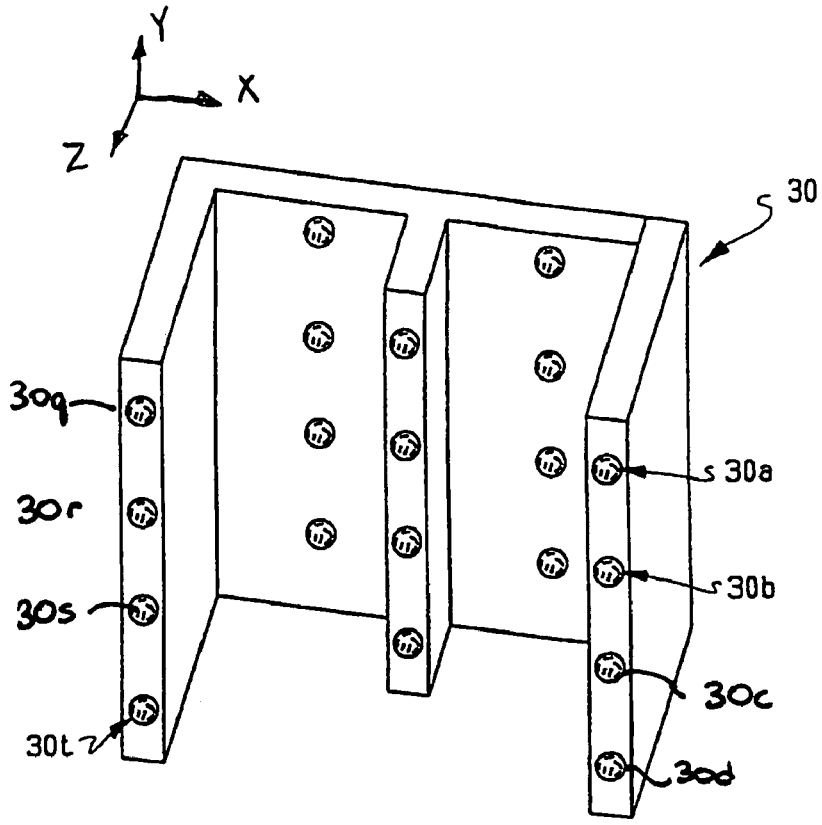
FIG. 6 is a perspective view of the calibration fixture carrying twenty illuminable areas.

In referencing the velocity of the clubhead to a direction downrange and a direction parallel to gravity, a third coordinate system can be created. In particular, this global coordinate system provides the resulting speed, spin rate, and path direction of the club at its hit location. The third coordinate system may be created by imaging a multi-marker calibration fixture 30 as illustrated in FIG. 6. The calibration may have 6 or more markers capable of defining at least 2 planes. As the number of markers placed on a calibration fixtures is increased, the accuracy of the calibration also may increase. Preferably the calibration fixture comprises 10 or more markers capable of defining 2 or more planes, and more preferably the calibration fixture comprises 15 or more markers defining 2 or more planes. In one embodiment, shown in FIG. 6, the markers are capable of defining 3 or more planes. By knowing the location of each marker, an image of the calibration fixture may be used to solve the equations below (Equations 3 and 4) for the $M_{global\text{-}camera}$ matrix.

$$U = -f\frac{T_x + M_{global-camera} \otimes G_{axis}}{T_z + M_{global-camera} \otimes G_{axis}} \quad \text{Equation 3}$$

$$V = -f\frac{T_y + M_{global-camera} \otimes G_{axis}}{T_z + M_{global-camera} \otimes G_{axis}} \quad \text{Equation 4}$$

The G-axis points placed in Equations 3 and 4 are located in the coordinate locations found in Table 1, which is an exemplary set of these three dimensional positions.

For a right handed golfer, global calibration of 15 points on a calibration fixture are given below. This fixture is directed downrange with the Y axis parallel to gravity and the X axis parallel to the downrange direction, and the Z axis being orthogonal to the X and Y axis to a create three-dimensional right-handed orthogonal coordinate system.

TABLE 1

G-axis points of Global Axis System with 15 points

| X axes | Y axes | Z axes |
|---|---|---|
| 0.0 | 2.0 | 1.5 |
| 0.0 | 1.0 | 1.5 |
| 0.0 | 0.0 | 1.5 |
| 1.0 | 2.0 | −1.5 |
| 1.0 | 1.0 | −1.5 |
| 1.0 | 0.0 | −1.5 |
| 2.0 | 2.0 | 0.0 |
| 2.0 | 1.0 | 0.0 |
| 2.0 | 0.0 | 0.0 |
| 3.0 | 2.0 | −1.5 |
| 3.0 | 1.0 | −1.5 |
| 3.0 | 0.0 | −1.5 |
| 4.0 | 2.0 | 1.5 |
| 4.0 | 1.0 | 1.5 |
| 4.0 | 0.0 | 1.5 |

Solving for the $M_{global\text{-}camera}$ matrix from the above equations (3 & 4) allows the markers measured in the camera system to be directly related to the global axis system.

Measuring System in Camera Coordinates

As a golfer swings clubhead unit 7 through field 35, the system electronic images are seen through camera 18 as shown on panel 18*p* in FIG. 8. As seen from one camera, the model photogrammetric equations to be solved given the camera coordinates U, V for the four club markers are as follows (Equations 5 and 6):

$$U = -f\frac{T_x + M_{club-camera} \otimes C_{club}}{T_z + M_{club-camera} \otimes C_{club}} \quad \text{Equation 5}$$

$$V = -f\frac{T_y + M_{club-camera} \otimes C_{club}}{T_z + M_{club-camera} \otimes C_{club}} \quad \text{Equation 6}$$

The U,V points in the image are related to the X,Y,Z coordinates of markers imaged in the CCD camera by f, the focal length of the lens and the X/Z ratio for the U image point and the Y/Z ratio for the V image point. Typically, the focal length of the lens for a half inch CCD sensor is from about 10 mm to about 50 mm, preferably from about 12 mm to about 35 mm, more preferably from about 16 mm to about 25 mm. In the above equations U and V are the imaged coordinates on the sensor chip and the quantities ($T_x$, $T_y$, $T_z$) are the translational coordinates of the body coordinate system from the focal point. The rotation of the body system relative to the camera system is given by the matrix representation ($M_{club\text{-}camera}$) with its origin at the average four body coordinate points ($C_x$, $C_y$, $C_z$) located on the club.

The four markers on the club (20*a-d* in FIG. 5) are utilized to solve the six (6) unknowns in the above equations for U and V in a least squares minimization. In particular, the six unknowns are $T_x$, $T_y$, $T_z$ and the three angles that uniquely describe the $M_{club\text{-}camera}$ matrix relating the orientation of the C axes (body coordinate system) with respect to the camera axes system.

System Operation

With calibration completed, the one-camera system of the present invention may be used to accurately monitor a golfer's swing. The camera of the present invention may be aimed or directed toward an area or field of view where a golfer will be swinging a club. A bail 8 may be teed or otherwise placed in the field of view of the camera. For example a ball 8 may teed up about 25 inches from camera 18. The club head 7 may then be placed behind ball 8 at address and club head unit 7 (on a shaft not shown) may be swung through the three-dimensional field of view 35 (FIG. 5).

As a club is swung toward the ball and is within about six inches of striking the ball, the club may cause a trigger, such as an optical (e.g., a laser or other light source) or ultrasonic trigger (see, e.g, U.S. application Ser. No. 10/667,479, incorporated herein in its entirety), to transmit a signal that ultimately causes the shutter of camera 18 to open and to expose the image sensor panel in camera 18 to light from the four (4) club unit 7 dots 20*a-d* and six (6) stationary ball dots 25*g-l*. Preferably, this illumination occurs when the club unit 7 is a position A (FIG. 5). Subsequently, approximately eight hundred microseconds later in one embodiment, a light source 22 fires a flash of light which again illuminates the club unit 7 markers or dots 20*a-d* and the ball markers or dots 25*g-l*. This occurs when the club unit 7 is a position B (FIG. 5).

In one embodiment, the flashes of light fire for between about 10 microseconds to about 100 microseconds in duration. Camera 18 may have very small apertures to reduce ambient light and enhance strobe light, such as an aperture of f8 or smaller for fluorescent markers or f22 or smaller for retroreflective markers. As light reflects from club markers 20*a-d* in their two positions, it reaches sensor panel 18*p* in corresponding panel areas 25*a-l* (FIG. 8). Using the known time between camera operation and the known geometric relationships between the cameras, the external computing circuits are able to calculate the X, Y and Z positions of each enhanced marker in a common coordinate system at the time of each snapshot. From the position information and the known data, the external computing circuits are able to calculate the clubhead velocity and spin rate in three dimensions during the immediate pre-impact ball 8 launch time period. With this information, it is then possible to extrapolate the club orientation and clubhead center position at the time when the club hits the ball. The extrapolation of clubhead orientation and clubhead center position is determined by calculation based on data from clubhead positions A and B data and the known position of stationery ball 8 from position B. In addition, the path direction, attack angle, and hit location are calculable from the positional information provided by the three reflective dots 30*u*, 30*v* and 30*y* on club unit 7.

In monitoring club motion, the operator reads in the gray-level threshold for the image and total exposure time of the scene. A photosensor (e.g., Tritronics sensor) senses the retroreflector marker on the club entering the camera viewing area and triggers the camera to expose. The captured image of the markers on the club at two or more strobed positions may be displayed on the video monitor for acceptance by the operator. The second strobe is set to fire at about 200 microseconds prior to the exposure time. This results in crisp images that are not overexposed from sunlight. A blob analysis subprogram finds the centroidal location of the 8 reflected club marker images and the six ball marker images and their shape. The six markers on the ball at the far end of the image is found and segmented from the club markers. These six ball markers allow the calculation of the position of the center of mass of the ball before impact which will then give an estimate of the hit location on the golf club face. Equations similar to 5 and 6 are employed to find the center of mass location.

With the adjustment to the input image scene completed, the translation of the club center ($T_x$, $T_y$, $T_z$) and three euler angles can be calculated from Equations 5 and 6 at the at least two positions captured in space. The coordinates of the calibration attachment placed on the face at the time of the calibration can be calculated at the two positions of the club to estimate the speed and orientation of the clubface prior to impact. The variables that can be measured are defined as follows:

1. Club Velocity (inches/second)
2. Attack Angle ($\arctan(V_y/[(V_x^2+V_z^2)^{1/2}])$)
3. Path Angle ($\arctan(V_x/V_z)$), where a positive value indicates the path of the swing was from right to left, and a negative value indicates the path of the swing was from left to right.
4. Spin Rate along Global System ($W_{xx}$, $W_{yy}$, $W_{zz}$)
5. Horizontal Hit Location, where a positive value reflects a horizontal hit location is toward the toe, and a negative value reflects a horizontal hit location toward the heel.
6. Vertical Hit Location, where a positive value reflects a high hit location, and a negative value reflects a low hit location.
7. Droop Angle, where a positive value reflects a club face scoring line tilting up from the horizontal plane (i.e., the toe is high), and a low value reflects a club face scoring line tilting down from the horizontal plane (i.e., the toe is down). In one embodiment, the droop angle may be determined by taking the average of the last two imaged positions of the club prior to ball impact.
8. Loft Angle, which is the angle between the vector that is normal to the club face at ball impact and the horizontal plane. In one embodiment, the loft angle may be determined by taking the average of the last two imaged positions of the club prior to ball impact.
9. Face Angle, which is the angle between the vector that is normal to the club face at ball impact and a vector pointing at the downrange target. In one embodiment, the face angle may be determined by taking the average of the last two imaged positions of the club prior to ball impact.

The final analysis involves transforming the results in the camera system to the global coordinate system by taking the transpose of the $M_{global\text{-}camera}$ matrix and multiplying the velocity and spin rate column vector that were calculated in the camera axis system.

$$V_{global}=\text{transpose}(M_{global\text{-}camera})V_{camera}$$

$$W_{global}=\text{transpose}(M_{global\text{-}camera})W_{camera}$$

From calculating the distance between the center of ball 8 and the center of the clubface 7*f* minus the radius of ball 8 and the velocity of the center of club face 7*f*, the time is calculated that it would take the last position of the clubface 7*f* to contact the surface of ball 8. Knowing this time, the position of the three clubhead unit 7 markers 20*a-c* can be calculated assuming the velocity of face 7*f* remains constant up until it reaches position C when impacting ball 8. With these club face 7*f* positions calculated at impact, the position of ball 8 relative to the center of the club face 7*f* can be calculated by finding the point of intersection of a line through the center of ball 8 and the normal to club face 7*f* plane found by using the three extrapolated club face points 31*a-c*.

As mentioned above, the path angle and attack angle are found from the components of velocity measured at the center of the face ($V_x$, $V_y$, $V_z$). They are defined as follows:

Path Angle=arctan ($V_x/V_z$)

Attack Angle=arctan ($V_y/[V_x^2+V_z^2]^{1/2}$)

With the automatic location of club velocity, path angle, attack angle and face hit location, the golfer receives quantitative information on his swing for teaching and club fitting purposes. In addition, the direction of the clubface plane can be calculated at impact.

One feature of the present invention is its capability to achieve high accuracy in measuring parameters of a golfer's swing. This allows the system of the present invention to be a useful tool for fitting a golfer to a club, a ball, or other golf equipment. Currently, the accuracy of a two-camera monitor is sufficiently accurate for fitting a golfer in this manner. For instance, by using a robotic swing machine to provide reproducible and controlled swing characteristics of a club, the following accuracy of a two-camera system was determined:

Two-Camera System Accuracy

| Parameter | Accuracy |
|---|---|
| Droop Angle | ±0.1 degrees |
| Droop Angle Spin Rate | ±10 rpm |
| Loft Angle | ±0.3 degrees |
| Loft Angle Spin Rate | ±30 rpm |
| Face Angle | ±0.3 degrees |
| Face Angle Spin Rate | ±10 rpm |
| Horizontal Hit Location | ±0.040 inch |
| Vertical Hit Location | ±0.035 inch |
| Club Speed | ±0.2 mph |
| Path Angle | ±0.2 degrees |
| Attack angle | ±0.2 degrees |

It is preferred that the accuracy of a single-camera system of the present invention is capable of being used for assisting in fitting a golfer with a club, a ball, or other golf equipment. For instance, the accuracy of a single-camera system of the present invention may be comparable to the accuracy of or more of the parameters stated above for a two-camera system. The accuracy of a single-camera system may depend upon the techniques used for calibration and the equipment selected for the system. For instance, a high resolution image sensor may provide greater accuracy during image analysis than a low resolution image sensor. Likewise, lens quality, the size of the field of view or scene of interest, the lighting used and its configuration, and the other factors also may affect the accuracy of the system.

It should be noted, however, that a system having slightly less accuracy may nevertheless permit a system to be used. For instance, the present invention may have the following accuracy when machine tested:

One-Camera System Accuracy

| Parameter | Accuracy | |
|---|---|---|
| Droop Angle | ±2 degrees | ±0.5 degrees |
| Droop Angle Spin Rate | ±60 rpm | ±20 rpm |

-continued

One-Camera System Accuracy

| Parameter | Accuracy | |
|---|---|---|
| Loft Angle | ±2 degrees | ±0.5 degrees |
| Loft Angle Spin Rate | ±180 rpm | ±60 rpm |
| Face Angle | ±2 degrees | ±0.5 degrees |
| Face Angle Spin Rate | ±60 rpm | ±20 rpm |
| Horizontal Hit Location | ±0.2 inch | ±0.05 inch |
| Vertical Hit Location | ±0.2 inch | ±0.05 inch |
| Club Speed | ±3 mph | ±1 mph |
| Path Angle | ±2 degrees | ±0.5 degrees |
| Attack angle | ±2 degrees | ±0.5 degrees |

EXAMPLES

In the following examples, each camera of a two camera system was configured and calibrated to operate as two single camera systems (one system for each camera) as well as a conventional two camera system. Several golf balls were then struck using a driver and iron and a swing analysis was performed by each of the three systems for each swing. The results of the swing analyses were then compared. As discussed below, the data from each of the three systems revealed that the accuracy of the one camera systems of the present invention was comparable to the accuracy previously only achieved with two cameras.

Example 1

A driver club was marked with four orange fluorescent circular markers. Two markers were placed on the toe separated by 0.96 inches and two markers placed on the shaft were separated by 1.51 inches. The club markers were then calibrated using a two-camera system as well as a one-camera system using the calibration steps described herein.

Six golf swings were analyzed with the calibrated club and measurements were made with the two cameras separated in the vertical direction. The cameras were separated vertically in height by about seven inches. The two cameras were focused at a distance of 25 inches from the field of view of the swing area. Both were Sony XCD-X700 cameras with 16 mm focal length lenses and orange 600 nm wavelength filters of 10 nm bandwidth. The average result of the six swings and the standard deviation are listed below computed from the bottom camera and top camera.

The results of the triangulation method described in a previous patent (U.S. Pat. No. 5,575,719 Gobush et al., the entirety of which is incorporated herein by reference) using a top and bottom set of cameras is listed in the last row. As can be seen from the results in Table 2, below, the two analyses taken from different orientations using only one of the top or bottom camera independently from the other were closely equivalent to the two camera system method.

TABLE 2

| | droop angle | loft angle | face angle | X impact inches | Y impact inches | speed in./sec. | path angle | attack angle |
|---|---|---|---|---|---|---|---|---|
| | | | Bottom Camera | | | | | |
| Measured | 16.08 | 8.21 | 7.35 | 0.33 | 0.10 | 1838.25 | 0.32 | −3.71 |
| Std. Dev. | 0.53 | 1.75 | 1.88 | 0.18 | 0.23 | 82.02 | 2.76 | 0.45 |
| | | | Top Camera | | | | | |
| Measured | 15.93 | 8.07 | 7.67 | 0.36 | 0.02 | 1836.17 | 0.72 | −3.73 |
| Std Dev. | 0.52 | 1.75 | 1.78 | 0.18 | 0.21 | 81.43 | 2.72 | 0.48 |
| | | | Both Cameras | | | | | |
| Measured | 16.20 | 7.96 | 7.19 | 0.35 | 0.07 | 1827.63 | 0.38 | −3.45 |
| Std. Dev. | 0.54 | 1.73 | 1.89 | 0.18 | 0.21 | 79.97 | 2.51 | 0.47 |

Example 2

A five iron club was marked with for orange fluorescent circular markers. Two markers were placed near the toe separated by 1.1 inches and two markers on the shaft were separated by 3.2 inches. The club marker positions were then calibrated. Six golf swings were taken with this calibrated club and measured using the three camera systems described above and used in Example 1.

The average results listed below are measurements computed from the bottom camera and top camera operating together as a two camera system and operating independently of each other as one camera systems. The results of the triangulation method for a two camera system described in a previous patent (U.S. Pat. No. 5,575,719 to Gobush et al.) is listed in the bottom row. As can be seen from the results shown in Table 3, the two computations with one camera once again is equivalent in accuracy and precision to the two camera system method.

TABLE 3

| | droop angle | loft angle | face angle | X impact inches | Y impact inches | speed in./sec. | path angle | attack angle |
|---|---|---|---|---|---|---|---|---|
| | | | Bottom Camera | | | | | |
| Measured | 11.05 | 17.83 | 5.81 | −0.14 | −0.65 | 1555.13 | −5.11 | −3.80 |
| Std. Dev. | 0.91 | 2.84 | 5.71 | 0.29 | 0.27 | 74.91 | 5.32 | 3.20 |
| | | | Top Camera | | | | | |
| Measured | 10.98 | 17.78 | 6.46 | −0.17 | −0.69 | 1549.69 | −4.34 | −3.82 |
| Std. Dev. | 0.88 | 2.83 | 5.17 | 0.28 | 0.27 | 77.02 | 4.81 | 3.23 |
| | | | Both Cameras | | | | | |
| Measured | 11.27 | 17.87 | 6.04 | −0.19 | −0.53 | 1539.40 | −4.72 | −3.68 |
| Std. Dev. | 0.97 | 2.84 | 5.04 | 0.28 | 0.28 | 73.72 | 4.70 | 3.18 |

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. For example, the compositions of the present invention may be used in a variety of golf equipment, for example, golf shoes for sole applications, as well as in inserts for golf putters. Such modifications are also intended to fall within the scope of the appended claims.

I claim:

1. A single-camera system for monitoring a movement of a striking instrument that impacts with an object comprising:

(a) a single camera unit having a light sensitive panel that is operable to be focused on a field of view through which the striking instrument passes prior to striking the object, wherein said single camera unit is operable to shutter or gate at least two times as the striking instrument and object pass through the field of view;

(b) three or more contrasting areas on the striking instrument and one or more contrasting areas on the object, said contrasting areas positioned so that light emitting therefrom reaches said light sensitive panels to form images thereon and create image signals when camera shutters are open;

(c) an image analyzer operable to discriminate between the striking instrument contrasting areas and the object contrasting areas and determining the conditions of a path and orientation of the striking instrument through the field; and (d) a rotatable calibration fixture having a pivot point and a plurality of predetermined contrasting areas, wherein three dimensional positions of the plurality of predetermined contrasting areas are known relative to each other, and wherein the striking instrument has a striking face, and wherein the striking instrument is calibrated such that the single-camera system is operable to identify a position and orientation of the striking face from the striking instrument contrasting areas, wherein a first calibration image of a first perspective view of the calibration fixture and first plurality of contrasting areas and the striking instrument and second plurality of contrasting areas is captured and the calibration fixture is rotated to a second orientation by the pivot point to provide a second perspective view of the calibration fixture and first plurality of contrasting areas and the striking instrument and second plurality of contrasting areas; wherein the striking instrument is a golf club comprising a club head and a club face and the object is a golf ball, wherein the image analyzer is operable to determine a club head path and face orientation during a swing of the golf club, and wherein the image analyzer is operable to determine a location of impact of the golf ball on the club face with an accuracy of 0.10 inch.

2. The system of claim 1, wherein the striking instrument is calibrated such that a spatial location of the contrasting areas are known relative to a geometric center of the striking face.

3. The system of claim 1, wherein the striking instrument is calibrated such that body coordinates of the striking instrument are known relative to the striking instrument contrasting areas.

4. The system of claim 1, wherein the striking instrument is calibrated with a priori knowledge of spatial locations of the striking instrument contrasting areas.

5. The system of claim 1, wherein the calibration fixture has 10 or more contrasting areas.

6. The system of claim 1, further comprising a calibration attachment having a plurality of contrasting areas, wherein the calibration attachment is operable to be disposed on the striking face, and wherein a position of at least one of the plurality of contrasting areas of the calibration attachment is known relative to the striking face when the calibration attachment is disposed on the striking face.

7. The system of claim 1, wherein the single camera unit is configured to capture at least one image of the striking instrument when the striking instrument is within about 2 inches or less from the object.

8. The system of claim 7, wherein the single camera unit is configured to capture at least one image of the striking instrument when the striking instrument is within about 1 inch or less from the object.

9. The system of claim 1, further comprising an electronic light source that emits light in two flashes onto the striking instrument and object.

10. The system of claim 1, wherein the striking instrument has four contrasting areas and the object has six contrasting areas.

11. The system of claim 1, wherein the golf club is a golf club driver or iron.

12. The system of claim 1, wherein the golf club is a putter.

13. The system of claim 1, wherein the image analyzer is operable to determine one or more of a droop angle, a loft angle, a face angle, a path angle, or an attack angle of the golf club.

14. The system of claim 13, wherein the accuracy of the image analyzer for determining the golf club droop angle, loft angle, face angle, path angle, or attack angle is within 3 degrees.

15. The system of claim 14, wherein the accuracy of the image analyzer for determining the golf club droop angle, loft angle, face angle, path angle, or attack angle is within 1 degree.

16. The system of claim 13, wherein the accuracy of the image analyzer for determining the golf club droop angle, loft angle, face angle, path angle, or attack angle is comparable to the accuracy of a 2-camera system.

17. The system of claim 1, wherein the image analyzer is operable to determine a club head velocity with an accuracy within 20 feet per second.

18. The system of claim 17, wherein the accuracy of the image analyzer for determining the club head velocity is comparable to the accuracy of a 2-camera system.

19. The system of claim 1, wherein the single camera unit is operable to shutter or gate at least three times as the striking instrument and object pass through the field of view.

20. The system of claim 1, further comprising a triggering unit for determining when the single camera unit captures an image of the striking instrument and object.

21. The system of claim 20, wherein the triggering unit comprises a light source, a reflector, and an optical sensor.

22. The system of claim 20, wherein the triggering unit comprises an ultrasonic emitter and receiver.

23. A method of monitoring a movement of a striking instrument that impacts with an object comprising the steps of:

(a) providing a single camera unit having a light sensitive panel that is operable to be focused on a first field of view;

(b) providing a calibration fixture having a pivot point and a first plurality of contrasting areas, wherein three-dimensional positions of the first plurality of contrasting areas are known relative to each other;

(c) placing the striking instrument in the calibration fixture at a first orientation within the first field of view, wherein the striking instrument comprises a second plurality of contrasting areas;

(d) capturing a first calibration image of a first perspective view of the calibration fixture and first plurality of contrasting areas and the striking instrument and second plurality of contrasting areas;

(e) rotating the calibration fixture to a second orientation by the pivot point to provide a second perspective view of the calibration fixture and first plurality of contrasting areas and the striking instrument and second plurality of contrasting areas;

(f) capturing a second calibration image of the second perspective view of the calibration fixture and first plurality of contrasting areas and the striking instrument and second plurality of contrasting areas;

(g) analyzing the first plurality and second plurality of contrasting areas in the first and second calibration images to create a three-dimensional global coordinate system;

(h) placing the striking instrument within the first field of view of the single camera unit to provide a first perspective view of the striking instrument and second plurality of contrasting areas;

(i) capturing a first image of the first perspective view of the striking instrument and second plurality of contrasting areas;

(j) providing a second perspective view of the striking instrument and second plurality of contrasting areas;

(k) capturing a second image of the second perspective view of the striking instrument and second plurality of contrasting areas;

(l) analyzing the second plurality of contrasting areas in the first and second images of the striking instrument to determine the three-dimensional positions of the second plurality of contrasting areas; and (m) determining a location of impact of the object on a face of the striking instrument from the three-dimensional positions of the second plurality of contrasting areas.

24. The method of claim 23, wherein the first perspective view of the striking instrument and second plurality of contrasting areas differs from the second perspective view of the striking instrument and second plurality of contrasting areas from about 5 to about 10 degrees.

25. The method of claim 24, wherein the step of providing a second perspective view of the striking instrument and second plurality of contrasting areas comprises repositioning the striking instrument.

26. The method of claim 25, wherein the step of providing a second perspective view of the striking instrument and second plurality of contrasting areas further comprises maintaining the first field of view of the single camera unit.

27. The method of claim 23, wherein the first plurality of contrasting areas comprises at least 10 contrasting areas.

28. The method of claim 23, wherein a first axis of the three-dimensional global coordinate system is parallel to gravity, a second axis of the global coordinate system is directed toward a target, and a third axis of the global coordinate system is orthogonal to the first and second axes.

29. The method of claim 23, wherein the steps of capturing the first image of the first perspective view of the striking instrument comprises capturing the first image prior to impact with the object.

30. The method of claim 23, further comprising the steps of:

providing a calibration attachment having a third plurality of contrasting areas, wherein three-dimensional positions of the third plurality of contrasting areas are known relative to each other;

placing the calibration attachment on a striking face of the striking instrument so that the first and second captured calibration images of the first and second perspective views of the striking instrument and second plurality of contrasting areas further comprise images of the third plurality of contrasting areas; and removing the calibration attachment from the striking face prior to the step of placing the striking instrument within the first field of view of the single camera unit.

31. The method of claim 29, wherein the step of capturing a second image of the second perspective view of the striking instrument and second plurality of contrasting areas comprises capturing the second image after impact with the object.

32. A method of monitoring a movement of a striking instrument that impacts with an object comprising the steps of:

(a) providing a single camera unit having a light sensitive panel that is operable to be focused on a first field of view;

(b) providing a calibration fixture having a pivot point and a first plurality of contrasting areas, wherein three-dimensional positions of the first plurality of contrasting areas are known relative to each other;

(c) placing the striking instrument in the calibration fixture at a first orientation within the first field of view, wherein the striking instrument comprises a second plurality of contrasting areas;

(d) capturing a first calibration image of a first perspective view of the calibration fixture and first plurality of contrasting areas and the striking instrument and second plurality of contrasting areas;

(e) rotating the calibration fixture to a second orientation by the pivot point to provide a second perspective view of the calibration fixture and first plurality of contrasting areas and the striking instrument and second plurality of contrasting areas;

(f) capturing a second calibration image of the second perspective view of the calibration fixture and first plurality of contrasting areas and the striking instrument and second plurality of contrasting areas;

(g) analyzing the first plurality and second plurality of contrasting areas in the first and second calibration images to create a three-dimensional global coordinate system;

(h) placing the striking instrument within the first field of view of the single camera unit to provide a first perspective view of the striking instrument and second plurality of contrasting areas;

(i) capturing a first image of the first perspective view of the striking instrument and second plurality of contrasting areas prior to striking the object;

(j) providing a second perspective view of the striking instrument and second plurality of contrasting areas;

(k) capturing a second image of the second perspective view of the striking instrument and second plurality of contrasting areas after striking the object;

(l) analyzing the second plurality of contrasting areas in the first and second images of the striking instrument to determine the three-dimensional positions of the second plurality of contrasting areas; and (m) determining a location of impact of the object on a face of the striking instrument and at least one of club velocity, attack angle, path angle, droop angle, loft angle, and face angle from the three-dimensional positions of the second plurality of contrasting areas.

33. The method of claim 32, wherein the object is a golf ball.

34. The system of claim 1, wherein the striking instrument is placed in proximity to the calibration fixture so that the camera is calibrated such that the single-camera system is operable to identify a position and orientation of the striking face from the predetermined contrasting areas of the calibration fixture and the striking instrument contrasting areas.

35. The method of claim 23, wherein the step of determining a location of impact is performed with an accuracy of 0.1 inch.

* * * * *